US006647964B1

(12) United States Patent
Schuricht

(10) Patent No.: US 6,647,964 B1
(45) Date of Patent: Nov. 18, 2003

(54) END OF INJECTION PRESSURE REDUCTION

(75) Inventor: Scott R. Schuricht, Normal, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/170,891

(22) Filed: Jun. 14, 2002

(51) Int. Cl.[7] ..... F02M 37/04
(52) U.S. Cl. ..... 123/446; 123/467; 123/496
(58) Field of Search ..... 123/446, 467, 123/496, 500, 501; 239/88–96

(56) References Cited

U.S. PATENT DOCUMENTS 4,640,252 A * 2/1987 Nakamura et al. ..... 123/446
5,287,838 A * 2/1994 Wells ..... 123/467
5,682,858 A * 11/1997 Chen et al. ..... 123/467
5,732,679 A * 3/1998 Takahasi et al. ..... 123/467
5,797,427 A * 8/1998 Buescher ..... 137/533.17
5,842,452 A * 12/1998 Pattanaik ..... 123/467
5,890,471 A * 4/1999 Nishimura ..... 123/496
5,893,350 A * 4/1999 Timms ..... 123/467
6,168,132 B1 * 1/2001 Frank et al.
6,253,736 B1 * 7/2001 Crofts et al. ..... 123/498

* cited by examiner

*Primary Examiner*—Carl S. Miller
(74) *Attorney, Agent, or Firm*—Michael R Huber

(57) ABSTRACT

End of injection rate shaping can be attained by controlling the flow rate into a check control cavity. Specifically, a flow control valve allows the check control cavity to vent at a first flow rate and to pressurize at a second slower flow rate. By pressurizing at a slower rate, end of injection does not occur as quickly, allowing injection pressure to decrease before injection is terminated.

13 Claims, 3 Drawing Sheets

END OF INJECTION PRESSURE REDUCTION

TECHNICAL FIELD

The present invention is related to end of injection pressure reduction and specifically to the operation of a check valve by controlling the flow rate into and out of a check control cavity.

BACKGROUND

Reducing emissions is a top priority for today's engine manufacturers. As the government continues to tighten emission requirements, manufacturers must find new ways to reduce engine emissions while still providing powerful, economic engine operation. One area that engine manufacturers have focused on is fuel injection.

Fuel injection plays a crucial role in the amount of emissions created during combustion. Numerous fuel injection variables, including fuel pressure, spray pattern, droplet size, number of injections and injection timing impact emissions. In order to properly control these parameters, fuel injectors have become more complicated and more precise. For example, one exemplary design of a fuel injector is a hydraulically actuated electronically controlled unit injector such as a Caterpillar HEUI® B unit injector. This unit injector uses actuation fluid to pressurize fuel for injection. This allows tight control over how the fuel is pressurized and the timing of the pressurization. Further, a direct operated check is used to better control the exact timing of the injection. Specifically, the check can be closed when actuation fluid is present in the check control cavity, thereby hydraulically overcoming or at least balancing the check against pressurized fuel and preventing injection. Injection is achieved when fuel is pressurized and the check control cavity is vented, allowing the fuel pressure to overcome a check spring bias and push the check open.

As emissions regulations have increased, further injection developments have occurred. For example, it may be desirable to control and vary injection pressure both at the beginning and end of injection. However, even today's advanced injectors may have difficulty controlling injection pressure at the beginning and the end of injection. For example, the hydraulically actuated electronically controlled unit injector briefly described above, can control the injection pressure at the beginning of the injection, allowing for a ramp rate shape but is designed to cut off injection almost immediately at the end of injection. Unfortunately, it has been shown that abruptly cutting off injection in this manner can cause unwanted emissions.

The present invention is intended to overcome one or more of the above problems.

SUMMARY OF THE INVENTION

In a first embodiment, a fuel injector comprises a nozzle tip defining a high pressure fuel cavity and an orifice connecting the high pressure fuel cavity to an outside to the nozzle tip. A check valve is at least partially disposed in the high pressure fuel cavity and moveable between a first position in which the orifice is in fluid communication with the high pressure fuel cavity and a second position in which the check blocks fluid communication of the orifice with the high pressure fuel cavity. The check has an opening hydraulic surface in said high pressure fuel cavity and a closing hydraulic surface in said check control cavity. The fuel injector also comprises a check control cavity, a first valve arrangement to selectively connect the check control cavity to a high pressure source or a low pressure drain, and a flow control valve in fluid communication with the check control cavity; the flow control valve having a first flow rate in a first direction and a second flow rate in a second direction.

In another embodiment, a method of operating a check with a check control cavity comprises venting the check control cavity at a first flow rate to allow injection and pressurizing the check control cavity at a second flow rate, different from the first flow rate to stop injection.

In another embodiment, a fuel injector comprises a nozzle tip defining a high pressure fuel cavity and an orifice connecting the high pressure fuel cavity to an outside to the nozzle tip. A check valve is at least partially disposed in the high pressure fuel cavity and moveable between a first position in which the orifice is in fluid communication with the high pressure fuel cavity and a second position in which the check blocks fluid communication of the orifice with the high pressure fuel cavity. The check has an opening hydraulic surface in said high pressure fuel cavity and a closing hydraulic surface in said check control cavity. The fuel injector also comprises a check control cavity, a first valve arrangement to selectively connect the check control cavity to a high pressure source or a low pressure drain, and means for controlling flow, the means being in fluid communication with the check control cavity and having a first flow rate in a first direction and a second flow rate in a second direction.

DETAILED DESCRIPTION

Figure 1:
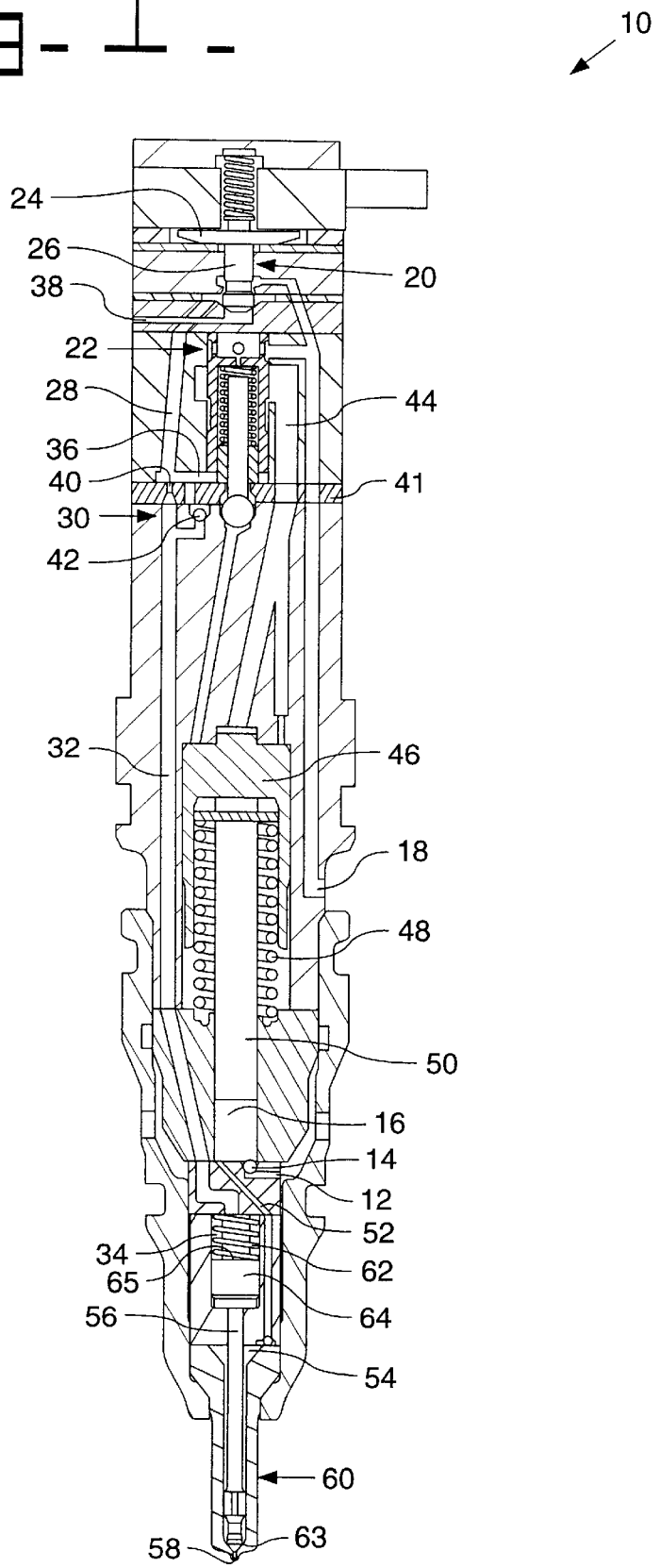
FIG. 1 is a diagrammatic illustration of a cross section of a fuel injector according to one embodiment of the present invention.

FIG. 1 is a diagrammatic illustration of a hydraulically actuated electronically controlled unit injector 10. Fuel enters injector 10 through fuel inlet passage 12, passes ball check 14 and enters fuel pressurization chamber 16. High pressure actuation fluid enters injector 10 through actuation fluid inlet passage 18. Actuation fluid then travels to control valve 20 and spool valve 22.

Control valve 20 controls the overall operation of injector 10 and operates as a pilot valve for spool valve 22. Control valve 20 includes an armature 24 and a seated pin 26. A solenoid (not shown) in control valve 20 controls movement of armature 24 and therefore the position of the seated pin 26. In a first position, seated pin 26 allows high pressure actuation fluid to travel through upper check passage 28 , past flow control valve 30 and through lower check passage 32 to check control cavity 34. When seated pin 26 is in the first position, high pressure actuation fluid also travels through upper check passage 28 to spool passage 36 to balance spool valve 22 in its first position. When seated pin 26 is in its second position, high pressure actuation fluid from actuation fluid inlet passage is blocked and upper check passage 28, lower check passage 32, check control cavity 34 and spool passage 36 are open to low pressure drain 38.

Figure 2:
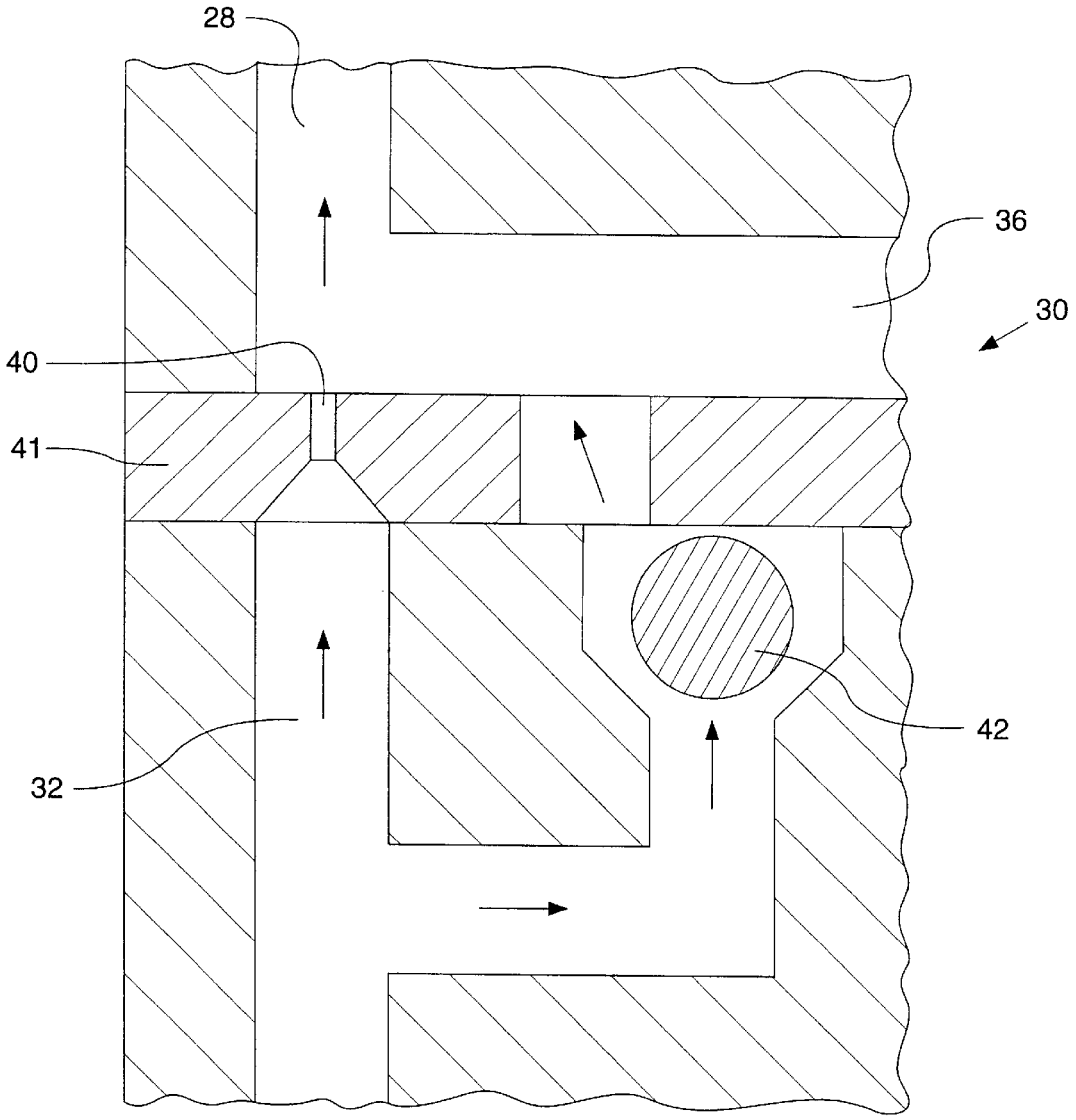
FIG. 2 is an enlarged diagrammatic illustration of a cross section of a flow control valve from the fuel injector in FIG. 1. according to one embodiment of the present invention.

Flow control valve 30 comprises a flow orifice 40, located in a damper plate 41, and a flow ball check 42 located in central body 43. Flow control valve 30 allows for different flow rates depending on the direction of the flow. When seated pin 26 is in the first position, allowing high pressure actuation fluid into check control cavity 34, the actuation fluid travels through flow orifice 40 but flow ball check 42 is closed (See FIG. 1). This results in a slower fill rate of check control cavity 34. When seated pin 26 is in its second position, opening check control cavity 34 to low pressure drain 38, flow travels through flow orifice 40 and also through flow ball check 42, due to the ball coming of its seat (See FIG. 2). This allows a faster venting flow rate the filling flow rate.

Figure 3:
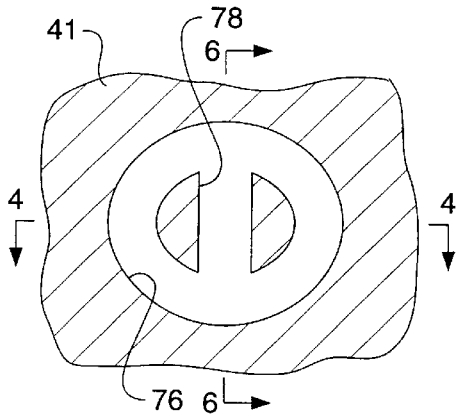
FIG. 3 is a diagrammatic illustration of a bottom view of a damper plate according to another embodiment of the present invention.
Figure 4:
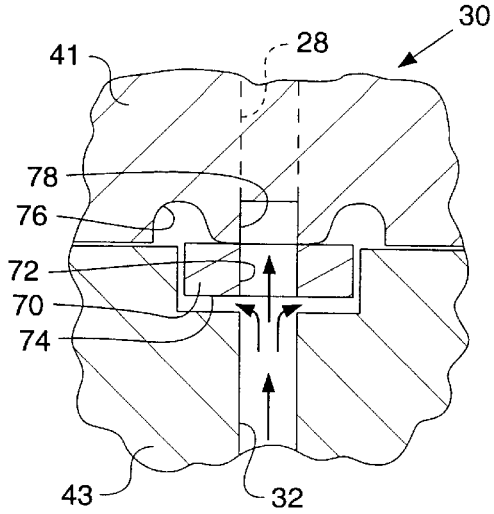
FIG. 4 is a diagrammatic illustration of a cross section of a flow control valve along line 4–4 of the embodiment illustrated in FIG. 3.

Alternative flow control valve configurations can be implemented. The key is having different flow rates depending on the direction of the flow. For example, in FIGS. 3–6, an alternative embodiment is illustrated. Flow control valve 30 regulates the flow between upper check passage 28 and lower check passage 32. In this embodiment, flow control valve 30 includes rate shaping orifice plate 70 and grooved damper plate 41. Rate shaping orifice plate 70 is a circular disk that defines rate shaping orifice 72 through the center of plate 70. Damper plate 43 defines a circular annulus 76 and a center passage 78 that is in fluid communication with circular annulus 76. When high pressure fluid is moving from upper check passage 28 to lower check passage 32, as illustrated in FIG. 3, rate shaping orifice plate 70 is pushed down, forming a seal with central body 43 and only allowing flow through rate shaping orifice 72. When fluid is ail moving from lower check passage 32 to upper check passage 28, as illustrated in FIG. 4, rate shaping orifice plate 70 is moved up, away from central body 43, allowing flow through rate shaping orifice 72 and around rate shaping orifice plate 70 in annular plate passage 74. This allows a high flow rate in the second direction.

When seated pin 26 is moved to its second position, the spool passage 36 is open to low pressure drain 38, which unbalances spool valve 22 and allows high pressure actuation fluid to travel through piston passage 44 and act upon intensifier piston 46. When high pressure actuation fluid acts upon intensifier piston 46, intensifier piston 46 moves downward, against the force of piston spring 48, causing plunger 50 to move downward and pressurize fuel in fuel pressurization chamber 16. Fuel in fuel pressurization chamber 16 is pressurized to injection pressure and is directed through high pressure fuel passage 52 and into fuel cavity 54.

Check 56 is located in the nozzle assembly of injector 10 and controls the flow of fuel through orifices 58, in nozzle tip 60, in to the combustion chamber (not shown). Check 56 is biased in the closed position by check spring 62. High pressure fuel in fuel cavity 54 acts on an opening surface 63 of check 56 and pushes it upwards, against check spring 62, into the open position, allowing injection through orifice 58. Check opening and closing is also hydraulically controlled by check control cavity 34. When high pressure actuation fluid is present in check control cavity 34, it helps keep check 56 closed even when high pressure fuel is present in fuel cavity 54. The high pressure actuation fluid acts upon a closing surface 65 of check piston 64 and hydraulically offsets and, in fact overcomes, the pressure from the high pressure fuel in fuel cavity 54. The high pressure actuation fluid helps close check-56 in combination with check spring 62. Injection occurs when check control cavity 34 is opened to low pressure drain 38, leaving the pressurized fuel to overcome only the check spring's 62 force. By controlling the high pressure actuation fluid in check control cavity 34, injection timing and duration can be more accurately controlled.

When injection is finished, seated pin 26 is returned to its first position, allowing high pressure actuation fluid into check control cavity 54 and spool passage 36. As stated above, high pressure actuation fluid in check control cavity 54 closes check 56. Further, high pressure actuation fluid in spool passage 36 causes spool valve 22 to return to its original position, stopping the flow of high pressure actuation fluid to the intensifier piston 46 and allowing the high pressure actuation fluid acting on the intensifier piston 46 to drain which allows intensifier piston 46 and plunger 50 to return to their original positions.

Industrial Applicability

Controlling injection pressure and timing is very important to reducing emissions. In particular, it is necessary to control injection pressure at the end of injection. Conventional wisdom dictated that injection should be terminated as quickly as possible, such that a high injection pressure was terminated as quickly as possible in a "square" rate shape. However, it has been learned that slowing the end of injection, while decreasing injection pressure, is beneficial to reducing emissions. (Essentially having a decreasing ramp rate shape at the end of injection.)

As explained above, injector 10 starts in a closed or no-injection state. Control valve 20 is in its first position providing high pressure actuation fluid to the control cavity 34. This insures that check 56 remains closed, preventing any fuel from entering the combustion chamber (not shown) through orifice 58. Control valve 20 also provides high pressure actuation fluid to spool passage 36, thereby biasing spool valve 22 in its first position, which prevents high pressure actuation fluid from acting on intensifier piston 46 and pressurizing fuel.

When injection is desired, control valve 20 is actuated causing seated pin 26 to move to its second position. This opens spool passage 36 to low pressure drain 38, allowing spool valve 22 to move to its second position. In its second position, spool valve 22 allows high pressure actuation fluid to act upon intensifier piston 46 which causes intensifier piston 46 and subsequently plunger 50 to move downward and pressurize fuel in fuel pressurization chamber 16. Pressurized fuel then moves to fuel cavity 54 where it acts on check 56, trying to push check 56 up, into the open position, so that injection can occur. When seated pin 26 is in the second position, check control cavity 34 is also opened to low pressure drain 38. This results in check spring 62 being the only thing that keeps check 56 closed; however, as fuel is pressurized, the force of pressurized fuel overcomes the force of the check spring 62 and moves the check 56 to its open position.

When injection is desired, it is important to properly vent check control cavity 34. Depending on the desired timing, it may be necessary to vent check control cavity 34 quickly (possibly faster than fuel is pressurizing) to allow the fuel pressure to control injection timing (by increasing in pressure to overcome the force of check spring 62.) This quick flow rate is achieved by allowing actuation fluid to travel through flow control valve 30. Flow control valve 30 includes a flow orifice 40 and a flow ball check 42. When flow check control cavity 34 is open to drain, flow travels through flow orifice 40 and also opens the flow ball check 42, allowing additional flow and a rather quick flow rate to low pressure drain 38.

When end of injection is desired, control valve 20 is de-actuated and seated pin 26 is moved back to its first position. This results in high pressure actuation fluid traveling back in to spool passage 36 to bias spool valve 22 and move it back to its first position. Moving back to its first position, spool valve 22 stops letting high pressure actuation fluid act on intensifier piston 46, which stops fuel pressurization. Additionally, when the seated pin 26 moves back to its first position, high pressure actuation fluid is again directed through flow control valve 30 and back into check control cavity 34 to insure check closure. When actuation fluid travels through flow control valve 30 in this direction, flow again travels through flow orifice 40 but the actuation fluid closes the flow ball check 42. This results in a slower flow rate into the check control cavity 34 than the flow rate out of the check control cavity 34.

The valve arrangement in the injector shown provides a fast moving control valve 20 and a slow moving spool valve 22. In conventional injectors, wanting a quick end of injection, the flow rate into and out of the check control cavity 34 was the same. This allowed quick venting to allow quick injection. Specifically, this allowed a ramped rate shape because the fuel pressure could overcome the check spring bias early in the pressurization stage and allow injection even as pressure was building. However, this flow rate for the check control cavity 34 also allowed a quick end of injection. As soon as the control valve 20 was actuated, high pressure actuation fluid would start entering check control cavity 34 and provide a quick end of injection even though spool valve 22 was just starting to react and fuel pressure may still be great enough to overcome the force of check spring 64. This prevented an end of injection ramp rate shape with decreasing pressure and instead provided a relatively square end of injection rate shape.

The flow control valve 30, as described above, counters the valve response times. Specifically, flow control valve 30 allows a first flow rate when the check control cavity is vented, similar to conventional designs, but allows a second, slower flow rate when pressurizing check control cavity 34. This causes a later end of injection and gives more time to spool valve 22 and intensifier piston 46 to react to the de-actuation of control valve 22. This results in a end of injection rate shape that looks more like a ramp than a square.

Figure 5:
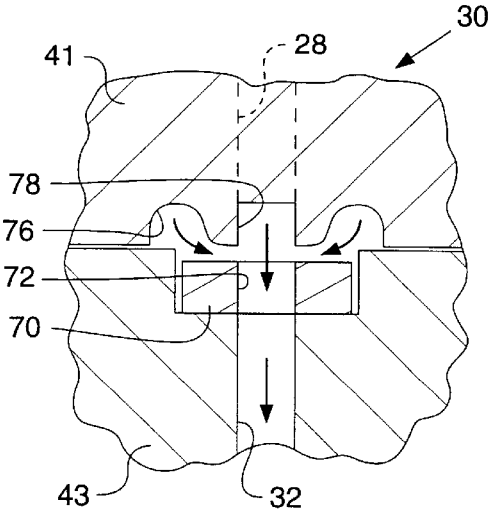
FIG. 5 is a diagrammatic illustration of a cross section of a flow control valve along line 4–4 of the embodiment illustrated in FIG. 3.
Figure 6:
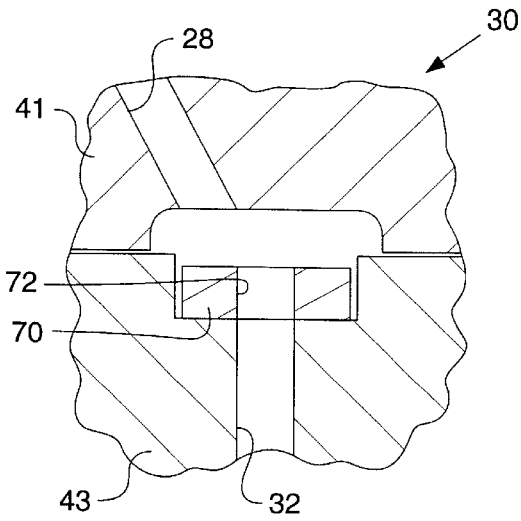
FIG. 6 is a diagrammatic illustration of a cross section of a flow control valve along line 6–6 of the embodiment illustrated in FIG. 3.

As illustrated above, control valve 30 could have alternative embodiments. For example, control valve 30 is shown in two different injector body pieces but the valve could be contained in one. In FIGS. 3–5, an alternative embodiment is shown in which a rate shaping orifice plate is shown. The key is creating different flow rates depending on the direction of flow. Further, the size of the valve and its passages and orifices can be sized according to each injector's specific design. Those skilled in the art will understand that modeling and experimentation on valve sizes will achieve desired results.

The present example has only illustrated a single injection event but multiple injections per engine cycle could be employed. Further, actuation fluid is preferably lubrication oil but could be any variety of other engine fluids, including fuel, coolant, or steering fluid.

The present example also illustrates the use of the flow control valve in a hydraulically actuated electronically controlled unit injector; however, the flow control valve could be used in a variety of other injector types, including common rail systems, or other hydraulic devices.

Other aspects, features, and advantages of the present invention may be obtained from a study of this disclosure and the drawings, along with the appended claims.

What is claimed is:

1. A fuel injector comprising:

a nozzle tip with a high pressure fuel cavity and an orifice connecting said high pressure fuel cavity to an outside of said nozzle tip;

a check valve at least partially slideably disposed in said high pressure fuel cavity and moveable between a first position in which said orifice is in fluid communication with said high pressure fuel cavity and a second position in which said check blocks fluid communication of said orifice with said high pressure fuel cavity;

a check control cavity;

said check valve having an opening hydraulic surface in said high pressure fuel cavity and a closing hydraulic surface in said check control cavity;

a first valve arrangement to selectively connect said check control cavity to either of a high pressure source and a low pressure drain;

a flow control valve in fluid communication with said check control cavity, said flow control valve having a first flow rate in a first direction and a second flow rate in a second direction;

wherein said first direction includes flow travel from said first valve arrangement to said check control cavity and said second direction includes flow travel from said check control cavity to said first valve arrangement; and wherein said first flow rate is less than said second flow rate.

2. The fuel injector of claim 1 wherein said flow control valve is passively operated.

3. The fuel injector of claim 1 wherein said flow control valve includes a first flow passage and a second flow passage.

4. The fuel injector of claim 3 wherein said first flow passage includes a flow orifice and said second flow passage includes a flow ball check.

5. The fuel injector of claim 1 wherein said flow control valve is at least partially disposed in a damper plate.

6. The fuel injector of claim 1 wherein said flow control valve is located near said first valve arrangement.

7. The fuel injector of claim 1 wherein said flow control valve includes a rate shaping orifice plate with a rate shaping orifice.

8. The fuel injector of claim 7 wherein said rate shaping orifice plate only allows flow through said rate shaping orifice said first direction and allows flow through said rate shaping orifice and around said rate shaping orifice plate said second direction.

9. A method of operating a check with a check control cavity comprising:

moving a flow control valve to a first position including moving a flow ball check to an open position, for venting said check control cavity at a first flow rate to allow injection; and moving said flow control valve to a second position for pressurizing said check control cavity at a second flow rate to stop said injection, said second flow rate being less than said first flow rate.

10. The method of claim 9 further including pressurizing fuel in conjunction with venting said check control cavity.

11. The method of claim 9 wherein pressurizing said check control cavity includes pressurizing said check control cavity at a rate such that an injection pressure decreases in a ramp rate shape before said injection is terminated.

12. A method of operating a check with a check control cavity comprising:

venting said check control cavity at a first flow rate to allow injection;

moving a rate shaping orifice plate to a first position, allowing flow to only travel through said rate shaping orifice; and pressurizing said check control cavity at a second flow rate to stop said injection, said second flow rate being less than said first flow rate.

13. A fuel injector comprising:

a nozzle tip with a high pressure fuel cavity and an orifice connecting said high pressure fuel cavity to an outside of said nozzle tip;

a check valve at least partially slideably disposed in said high pressure fuel cavity and moveable between a first position in which said orifice is in fluid communication with said high pressure fuel cavity and a second position in which said check blocks fluid communication of said orifice with said high pressure fuel cavity;

a check control cavity;

said check valve having an opening hydraulic surface in said high pressure fuel cavity and a closing hydraulic surface in said check control cavity;

a valve arrangement to selectively connect said check control cavity to either of a high pressure source and a low pressure drain; and means for controlling a flow rate between said valve arrangement and said check control cavity, said means having a first flow rate from said valve arrangement to said check control cavity and a second flow rate, greater than said first flow rate, from said check control cavity to said valve arrangement.

* * * * *